US009527635B2

(12) United States Patent
Metz

(10) Patent No.: US 9,527,635 B2
(45) Date of Patent: Dec. 27, 2016

(54) DUAL FLOW CAP ASSEMBLY FOR CONTAINER

(71) Applicant: John Metz, Stony Brook, NY (US)

(72) Inventor: John Metz, Stony Brook, NY (US)

( * ) Notice: Subject to any disclaimer, the term of this patent is extended or adjusted under 35 U.S.C. 154(b) by 0 days.

(21) Appl. No.: 14/791,766

(22) Filed: Jul. 6, 2015

(65) Prior Publication Data

US 2016/0023221 A1 Jan. 28, 2016

Related U.S. Application Data

(60) Provisional application No. 62/028,415, filed on Jul. 24, 2014.

(51) Int. Cl.

| | |
|---|---|
| ***B05B 1/30*** | (2006.01) |
| ***B65D 47/24*** | (2006.01) |
| ***B05B 1/34*** | (2006.01) |
| ***B05B 11/04*** | (2006.01) |

(52) U.S. Cl.

CPC ..... *B65D 47/243* (2013.01); *B05B 1/3046* (2013.01); *B05B 1/3405* (2013.01); *B05B 1/3436* (2013.01); *B05B 11/043* (2013.01); *B65D 2101/0023* (2013.01)

(58) Field of Classification Search

CPC ..... B65D 47/243; B65D 2101/0023; B05B 1/3046; B05B 1/3436; B05B 1/3405; B05B 11/043

USPC ..... 239/327, 491, 492, 506, 507, 583

See application file for complete search history.

(56) References Cited

U.S. PATENT DOCUMENTS

| | | | | |
|---|---|---|---|---|
| 3,504,893 | A * | 4/1970 | Hoshi | B05B 1/3447 239/327 |
| 4,667,881 | A * | 5/1987 | Michelotti | B65D 47/247 222/525 |
| 5,104,008 | A | 4/1992 | Crisci | |
| 5,429,282 | A * | 7/1995 | Stebick | B65D 47/243 222/525 |
| 5,472,120 | A | 12/1995 | Stebick et al. | |
| 5,507,416 | A | 4/1996 | Rapchak et al. | |
| 5,609,276 | A | 3/1997 | Greatbatch | |

* cited by examiner

*Primary Examiner* — Steven J Ganey

(74) *Attorney, Agent, or Firm* — Carter, DeLuca, Farrell & Schmidt, LLP; Francesco Sardone

(57) ABSTRACT

The present disclosure relates to a pull/push type closure or cap assembly, which is compatible with a number of plastic bottles for providing two different types of fluid flow therethrough.

16 Claims, 4 Drawing Sheets

DUAL FLOW CAP ASSEMBLY FOR CONTAINER

CROSS-REFERENCE TO RELATED APPLICATIONS

The present application claims the benefit of and priority to U.S. Provisional Application Ser. No. 62/028,415, filed Jul. 24, 2014, which is hereby incorporated by reference in its entirety.

BACKGROUND

1. Technical Description

The present disclosure relates to a reusable cap assembly with two distinct positions, including a first misting position and a second full normal flow position. More specifically, the present disclosure relates to a pull/push type closure or cap assembly, which is compatible with a number of plastic bottles for providing two different types of fluid flow therethrough.

2. Background of Related Art

A traditional pull/push type cap has become a common feature on most bottles. This type of cap is usually comprised of a shell portion, which attaches to the bottle by way of a shoulder piece. Encased by the shell portion is cylindrical chimney. Secured to the chimney, by way of radially extending spoke(s), is a single, solid stem surrounded by an annular channel with openings therein for fluid to pass from the bottle to the cap. The shell portion is perpendicularly movable with respect to the shoulder piece, while the chimney and stem remain immobile. In operation the shell is pulled up causing a space between it and the chimney, stem and annular channel, which creates a single central pouring aperture allowing fluid to flow from the bottle to the cap.

This type of cap allows the user quick and easy access to the fluid contained within the bottle. Additionally, this cap allows the user to open the cap while using only one hand rather than two hands, which is required by a twisted cap. However, in the above described traditional pull/push type cap with a single central pouring aperture only a single dispensing option is available. A user cannot choose between pouring or misting.

Accordingly, a need exists for a pull/push type closure or cap assembly and/or sport bottle including the same, that is capable of providing multiple flow positions including pouring and misting. For example, bottles are being used in general as drink containers, and more specifically as sport drink containers. Users of these drink containers desire quick and easy access to the fluid in the bottle while having the option between pouring and misting. The traditional pull/push type cap does not provide the convenient access to the fluid contained within the bottle and the option between pouring and misting.

SUMMARY

The objective of this invention is to provide a cap that permits both a mist and full flow option. Another objective is to provide a reusable cap and/or a reusable, compressible bottle for said reusable cap.

To achieve the first objective a pull/push type cap with two distinct positions will be disclosed herein. The cap includes a shell portion, which is attached to a bottle by way of a shoulder piece. Secured to the shoulder piece is a cylindrical chimney, which is encased by the said shell portion. Connected to the chimney, by way of at least two radially extending spokes, is a single, hollow stem surrounded by an annular channel with openings therein for fluid to pass from the bottle to the cap. Within the hollow stem is disposed a misting nozzle.

In operation when the cap is in the first position (i.e., closed condition), if pressure is applied by the user on the bottle, the cap will release a light refreshing mist through the misting nozzle.

Furthermore, when the cap is moved from first position to second position (i.e., open condition) a space or fluid channel is created between the shell portion and the chimney. In the second position, the hollow stem, including the misting nozzle, and the annular channel together define a central pouring aperture that allows a full normal flow of fluid through the cap.

To achieve the second objective, a reusable plastic bottle will be disclosed herein. The plastic bottle will be comprised of polyethylene terephthalate (PET) plastic, polytetrafluoroethylene (PTFE) or any plastic that displays characteristics of recyclability, reusability, compressibility, resiliency and durability.

In particular, this invention discloses a resilient plastic bottle that can withstand repeated use and/or squeezing without diminishing the elasticity of the plastic.

In operation when the cap is in the first position, the plastic bottle will allow a user to exert a minimal amount of pressure on the bottle, which will sufficiently compress the bottle, allowing the cap to release a light refreshing mist through the misting nozzle.

According to an aspect of the present disclosure, a push/pull-type closure for a fluid container is provided and includes a shoulder piece adapted to be secured to the fluid container. The shoulder piece includes a cylindrical chimney defining a chimney lumen; and a stem supported within the chimney lumen by a plurality of spokes. The stem is configured and dimensioned such that a first fluid flow channel is defined between the chimney and stem providing fluid communication between an interior and an exterior of the container. The push/pull-type closure also includes an outer shell coupled to the chimney of the shoulder piece. The outer shell defines a lumen therethrough and along the first fluid flow channel, the outer shell being axially movable relative to the chimney of the shoulder piece between a first position and a second position, wherein the first position the distal opening of the outer shell is of fluid sealing contact with the chimney of the shoulder piece to close the first fluid flow channel and wherein the second position the outer shell is extended away from the stem of the shoulder piece to open the first fluid flow channel. The push/pull-type closure also includes a misting nozzle attached to the stem of the shoulder piece, the misting nozzle defining a second fluid flow channel therethrough, wherein the second fluid flow channel provides fluid communication between the interior and exterior of the container, wherein the second fluid flow channel is open at all times.

The misting nozzle may further include a misting cap body located centrally within the stem.

The misting nozzle may further include a misting cap. The misting cap may be located centrally within the misting cap body. The misting cap may be positioned distally from the container within the misting cap body defining a misting cap lumen through which fluid flows.

The misting nozzle may further include at least a spoke within the misting cap lumen. The spoke may be located distally from the misting cap within the misting cap lumen.

The misting nozzle may further include a nozzle insert located within the misting cap lumen of the misting cap. The nozzle insert may be positioned to allow for the flow of fluid past the nozzle insert and the misting cap to the distal opening of the outer shell. The nozzle insert may be supported by at least one spoke.

In use, when the outer shell is in the first position, only the second fluid flow channel is open. The second fluid flow channel may define a fluid flow rate therethrough.

In use, when the outer shell is in the second position, the first fluid flow channel and the second fluid flow channel are open. The first fluid flow channel may have a fluid flow rate greater than the fluid flow rate of the second fluid flow channel.

The misting nozzle may be supported within a lumen of the stem of the chimney, and wherein the second fluid flow channel may extend through the stem of the chimney.

The misting nozzle may further include a misting cap body fixedly supported within a central lumen of the stem.

The misting nozzle may further include a misting cap. The misting cap may be located within the misting cap body. The misting cap may be positioned distally from the container within the misting cap body defining a misting cap lumen through which fluid flows.

The misting nozzle may further include at least a spoke within the misting cap lumen. The spoke may be located distally from the misting cap within the misting cap lumen.

The misting nozzle may further include a nozzle insert located within the misting cap lumen of the misting cap. The nozzle insert may be positioned to allow for the flow of fluid past the nozzle insert and the misting cap to the distal opening of the outer shell. The nozzle insert may be supported by at least one spoke.

The second fluid flow channel may extend between the nozzle insert and the misting cap to the distal opening of the outer shell.

In use, when the outer shell is in the first position, only the second fluid flow channel is open, wherein the second fluid flow channel defines a fluid flow rate therethrough.

Also in use, when the outer shell is in the second position, the first fluid flow channel and the second fluid flow channel are open, wherein the first fluid flow channel has a fluid flow rate greater than the fluid flow rate of the second fluid flow channel.

BRIEF DESCRIPTION OF DRAWINGS

In order that the invention of the present disclosure may be clearly understood, preferred embodiments thereof will be described below with reference to the accompanying photographs, in which.

DETAILED DESCRIPTION OF DRAWINGS

Figure 1:
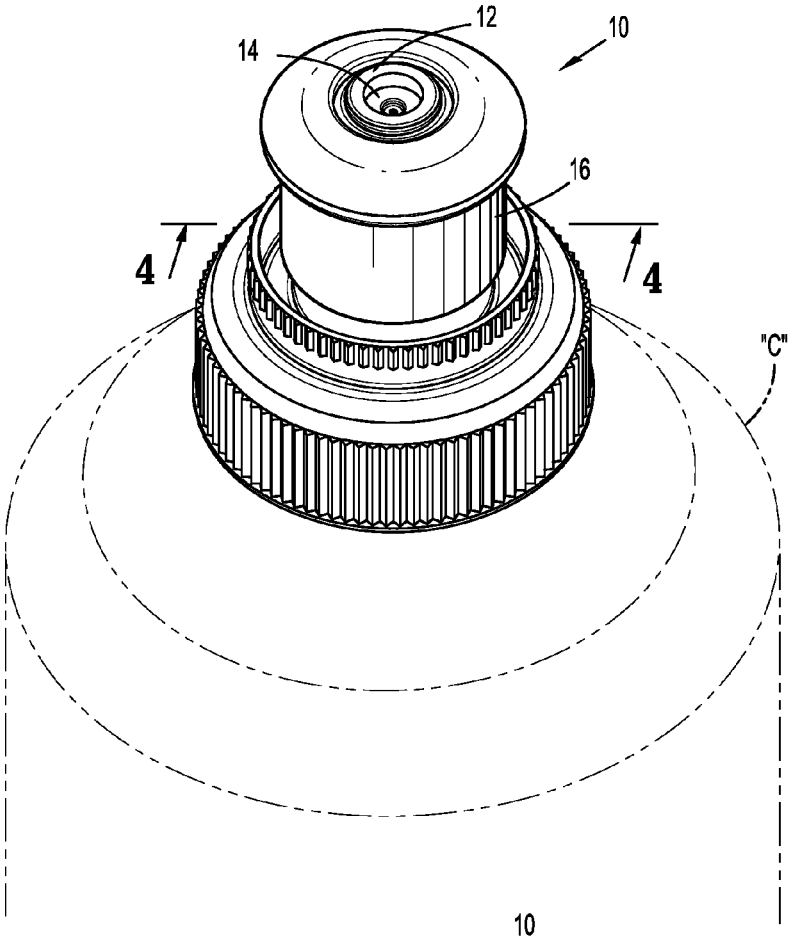
FIG. 1 is a top, perspective view of a cap assembly of the present disclosure, shown in a misting position, mounted to a reusable plastic container, enabling only a misting flow.

Referring initially to FIG. 1 there is shown a push/pull-type closure or cap assembly 10 of the present disclosure, in a first misting position, which is mounted to the neck of a plastic bottle container "C". With reference to FIGS. 1-5B, cap assembly 10 includes a shell or shoulder piece 18 configured for threaded connections to a threaded stem of container "C."

Cap assembly 10 includes a chimney 20 extending from shoulder piece 18 and defining a central lumen 20*a* therethrough.

Cap assembly 10 further includes a stem 12 suspended within the lumen 20*a* of chimney 20 by at least one spoke 12*b* (see FIG. 5C) or the like. Stem 12 defines a central lumen 12*a* therethrough.

Cap assembly 10 also includes an outer shell or cap 16 slidably supported on chimney 20. Outer shell 16 defines a central lumen 16*a* having an open distal end 16*b*. Distal end 16*b* of outer shell 16 is configured and dimensional to form a fluid tight seal with a distal end of stem 12 when outer shell 16 is in a first closed position (as will be described below).

Cap assembly 10 additionally includes a misting nozzle 14 fixedly supported within lumen 12*a* of stem 12 for integration therewithin. Misting nozzle 14 includes a misting cap 14*a* supported in a lumen 14*c* of a cylindrical misting shell or body 14*b*. Misting cap 14*a* defines a lumen or bore 14*d* having an open distal end 14*e*. Misting nozzle 14 includes a nozzle insert 14*f* supported in lumen or bore 14*c* of misting shell or body 14*b* by at least one spoke, ledge or shelf 14*g*.

Open distal end 14*e* of misting cap 14*a* may have a diameter of about 0.022 inches. An annular gap between misting cap 14*a* and nozzle insert 14*f* may have a width or thickness of about 0.0075 inches.

Figure 3A:
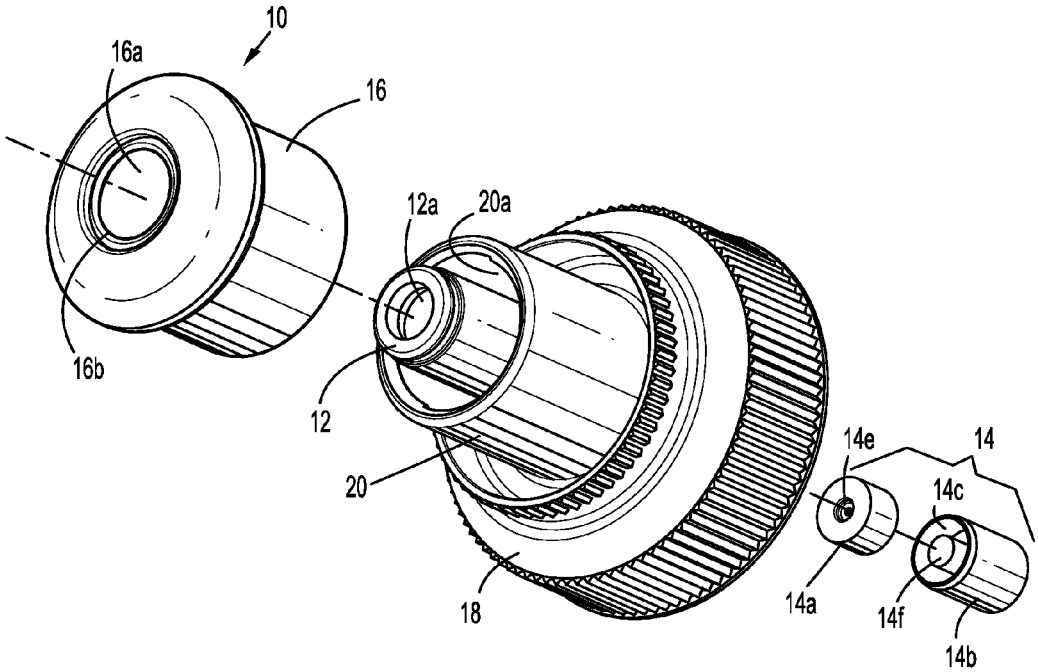
FIG. 3A is a perspective view, with parts separated, of the cap assembly, showing a misting nozzle separated a stem of cap assembly, the missing nozzle shown separated into a misting cap and misting shell.
Figure 3B:
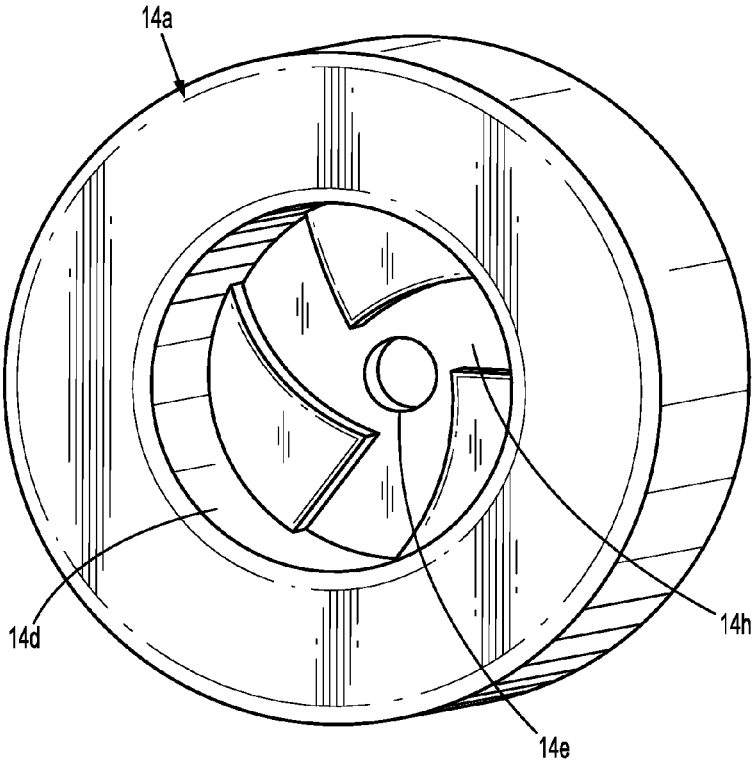
FIG. 3B is an enlarged proximal view of the misting cap illustrating an interior thereof.
Figure 4:
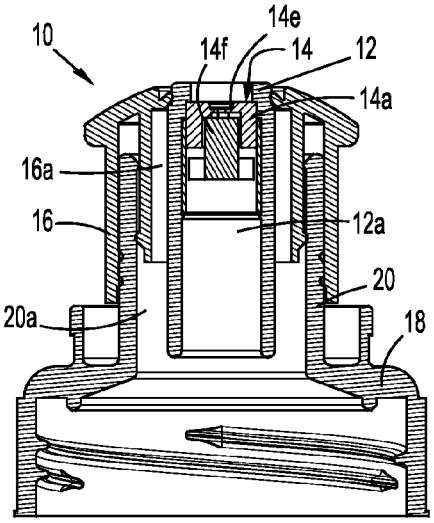
FIG. 4 is a cross-sectional side elevation of the cap assembly of FIG. 1, as taken through 4-4 of FIG. 1, with the cap assembly shown in the closed misting position.

With reference momentarily to FIG. 3B, misting cap 14*a* includes a series or an array of arcuate channels 14*h* formed in a proximal surface of a distal wall thereof, wherein each arcuate channel 14*h* is in fluid communication with open distal end 14*e* of misting cap 14*a*. In accordance with the present disclosure, arcuate channels 14*h* direct the flow of second fluid flow "F2" (as will be described in greater detail below) into a circular vortex or the like to assist with the creation of a mist of second fluid flow "F2" as second fluid flow "F2" exits open distal end 14*e* of misting cap 14*a*.

As seen in FIGS. 1 and 3A-5C, cap assembly 10 is movable between a first position for misting and a second position for full fluid flow. When the cap assembly 10 is in the first position (FIGS. 1 and 4) the stem 12 and the misting nozzle 14 are substantially flush with the shell 16. In this position, the shell 16 is in direct fluid sealing contact with the stem 12, inhibiting or blocking the formation a first flow path or channel "F1" that would allow a full fluid flow. Accordingly, when pressure is applied to a container "C" (on which cap assembly 10 is secured), fluid is only permitted to flow through a second flow path or channel "F2" extending through lumen 12A of stem 12, between nozzle insert 14*f* and misting cap 14*a* of misting nozzle 14, and out through open distal end 14*e* of misting nozzle 14, where it will escape through the misting nozzle 14, which will produce a mist of fluid.

Figure 2:
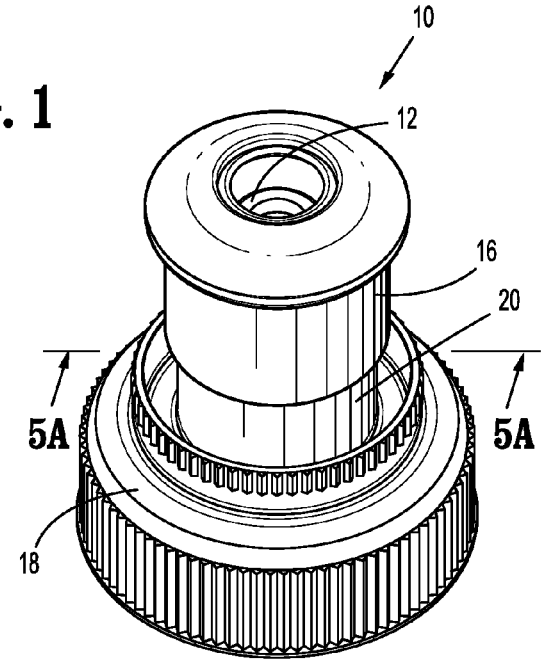
FIG. 2 is a top, perspective view of the cap assembly of FIG. 1 with the cap assembly shown a second full normal flow position.
Figure 5A:
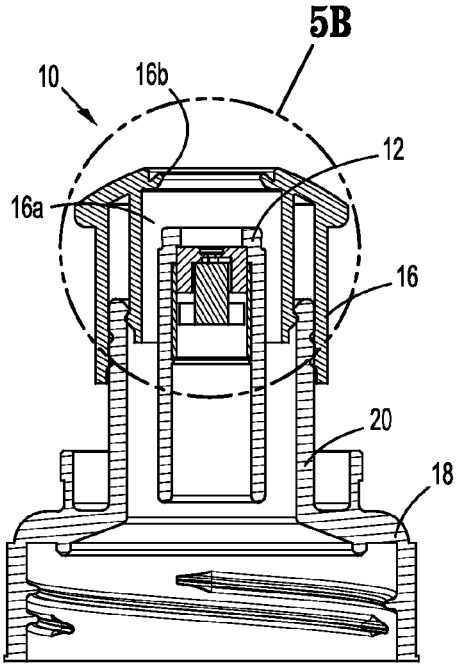
FIG. 5A is a cross-sectional side elevation of the cap assembly of FIG. 2, as taken through 5A-5A of FIG. 2, showing the cap assembly in the open free flow position.

As seen in FIG. 2 and FIG. 5A, with cap assembly 10 in the first position, when the shell 16 is pulled perpendicular with respect to the shoulder piece 18, cap assembly 10 is moved to a second position. In the second position, the outer shell 16 loses its direct fluid sealing contact with respect to the stem 12, allowing the formation of a central pouring aperture, or first flow path or channel "F1" that will permit a full normal flow of fluid from the bottle or container "C." In this position, when the bottle or container "C" is inverted or pressure is applied to the exterior of the bottle or container, fluid will flood the lumen 20*a* of chimney 20 and lumen 16*a* of outer shell 16, it will escape through the central pouring aperture or distal end 16*b* of outer shell 16, and at least partially bypass the misting nozzle 14, producing a full normal flow of fluid along the first flow path or channel "F1." It is understood that some fluid may also travel along second flow path or channel "F2" when cap assembly 10 is in the second position.

As seen in FIG. 5A, while the cap assembly 10 is in the second position, the first flow path or channel "F1" allows for the partial flow of fluid around the misting nozzle 14. The first flow path or channel "F1" also reduces the pressure that would otherwise be exerted on the misting nozzle 14 by diverting fluid to lumen 20*a* of chimney 20 and lumen 16*a* of outer shell 16.

Figure 5B:
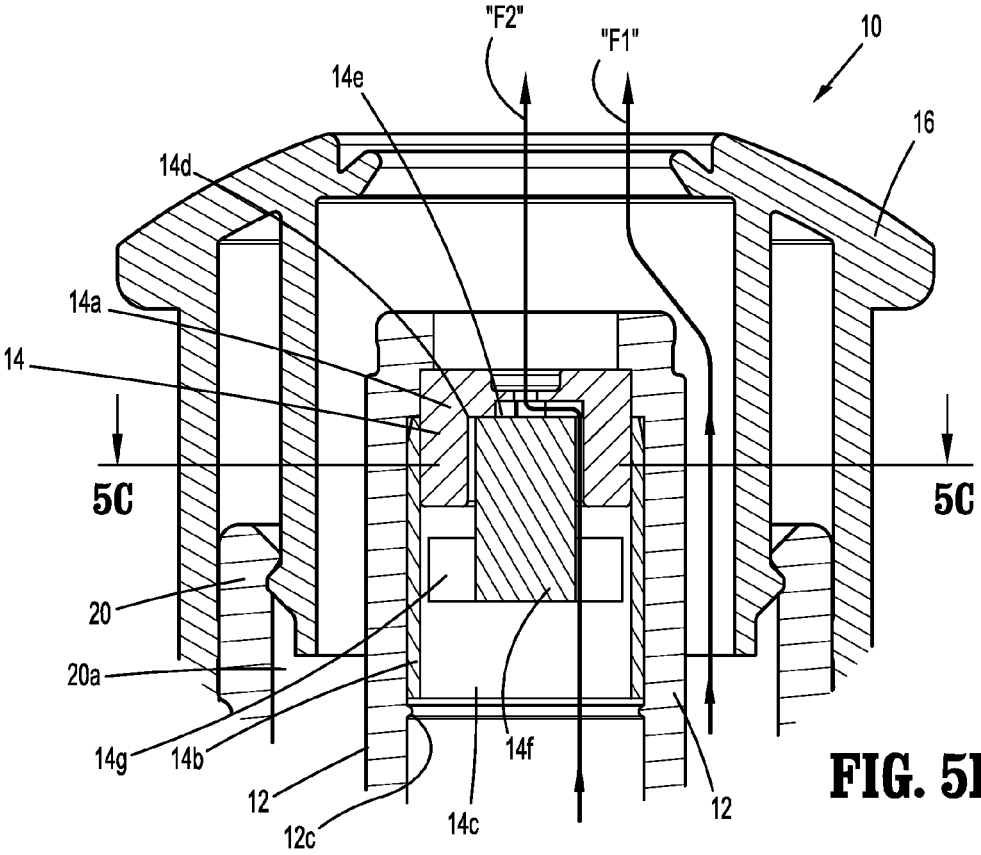
FIG. 5B is a an enlarged detail view of the indicated area of detail shown in FIG. 5A.
Figure 5C:
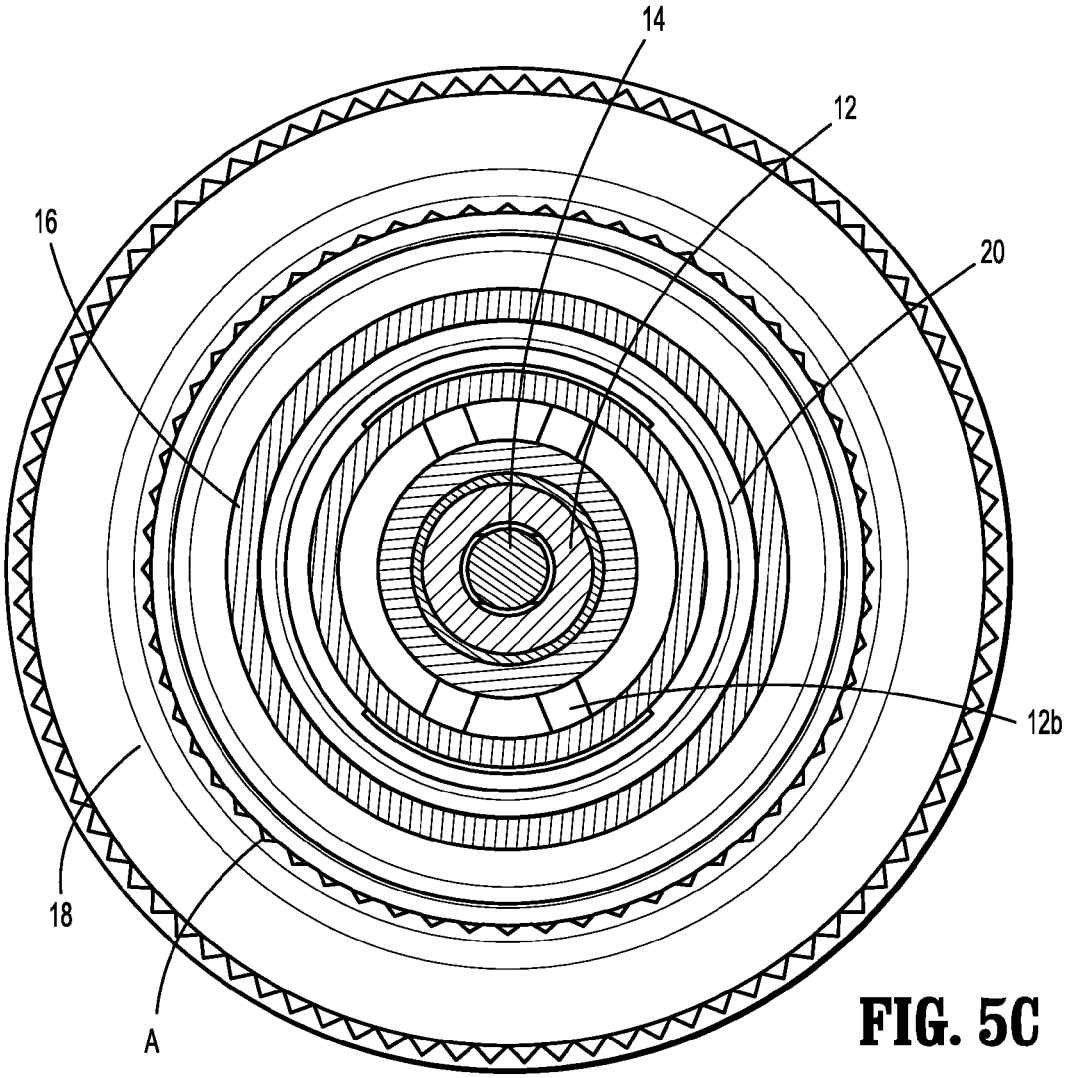
FIG. 5C is a cross-sectional plan of the cap assembly of FIG. 5B as taken through 5C-5C of FIG. 5B.

As seen in FIG. 3A, the cap assembly 10 may be assembled by vertically sliding the outer shell 16 onto the stem 12. The misting nozzle 14 may be attached or secured to the interior (e.g., in lumen 12*a*) of the stem 12 via a snap-fit or friction fit connection or glued thereto. Specifically, as seen in FIG. 5B, stem 12 includes an annular ridge 12*c* projecting radially inward from into lumen 12*a* of stem 12. Ridge 12*c* of stem 12 functions to maintain misting nozzle 14 within lumen 12.

It is contemplated to have a pair of opposed shelves 14*g* (one shown in FIG. 5B) projecting into lumen 14*c* of misting shell or body 14*b* for supporting nozzle insert 14*f* therewithin so as to ensure the stability of the misting nozzle 14 throughout the life of cap assembly 10. While a pair of shelves 14*g* are shown and described, it is contemplated that any number of shelves or spokes may be used for the intended purpose.

In accordance with the present disclosure, when the cap assembly 10 is in the second position, the second fluid flow path or channel "F2" defines a second rate of fluid flow, and the first fluid flow path or channel "F1" defines a first rate of fluid flow that is greater than the second rate of fluid flow. Additionally, when the cap assembly 10 is in the first position, the rate of fluid flow of first fluid flow path or channel "F1" is less than the second fluid flow path or channel "F2," wherein the rate of fluid flow of second fluid path or channel "F2" may be zero.

While cap assembly 10 has been shown and described as opening and closing upon a pulling or pushing of outer shell 16 relative to chimney 20, it is contemplated and within the scope of the present disclosure that cap assembly 10 may be opened and closed upon the clockwise or counter-clockwise rotation of outer shell 16 relative to chimney 20.

It will be understood that various modifications may be made to the embodiments of the presently disclosed cap assembly 10 and components thereof. Therefore, the above description should not be construed as limiting, but merely as exemplifications of embodiments. Those skilled in the art will envision other modifications within the scope and spirit of the present disclosure.

What is claimed is:

1. A push/pull-type closure for a fluid container comprising:

a shoulder piece adapted to be secured to the fluid container, the shoulder piece including:

a cylindrical chimney defining a chimney lumen; and a stem supported within the chimney lumen by a plurality of spokes, the stem being configured and dimensioned such that a first fluid flow channel is defined between the chimney and stem providing fluid communication between an interior and an exterior of the container;

an outer shell coupled to the chimney of the shoulder piece, the outer shell defining a lumen therethrough and along the first fluid flow channel, the outer shell being axially movable relative to the chimney of the shoulder piece between a first position and a second position, wherein the first position a distal opening of the outer shell is of fluid sealing contact with the chimney of the shoulder piece to close the first fluid flow channel and wherein the second position the outer shell is extended away from the stem of the shoulder piece to open the first fluid flow channel; and a misting nozzle attached to the stem of the shoulder piece, the misting nozzle defining a second fluid flow channel therethrough, wherein the second fluid flow channel provides fluid communication between the interior and exterior of the container, wherein the second fluid flow channel is open at all times.

2. The push/pull-type closure of claim 1, wherein the misting nozzle further comprises a misting cap body located centrally within the stem.

3. The push/pull-type closure of claim 2, wherein the misting nozzle further comprises a misting cap, the misting cap being located centrally within the misting cap body, the misting cap positioned distally from the container within the misting cap body defining a misting cap lumen through which fluid flows.

4. The push/pull-type closure of claim 3, wherein the misting nozzle further comprises at least a spoke within the misting cap lumen, the spoke located distally from the misting cap within the misting cap lumen.

5. The push/pull-type closure of claim 4, wherein the misting nozzle further comprises a nozzle insert located within the misting cap lumen of the misting cap, the nozzle insert positioned to allow for the flow of fluid past the nozzle insert and the misting cap to the distal opening of the outer shell, the nozzle insert supported by at least one spoke.

6. The push/pull-type closure of claim 1, wherein when the outer shell is in the first position, only the second fluid flow channel is open, wherein the second fluid flow channel defines a fluid flow rate therethrough.

7. The push/pull-type closure of claim 6, wherein when the outer shell is in the second position, the first fluid flow channel and the second fluid flow channel are open, wherein the first fluid flow channel has a fluid flow rate greater than the fluid flow rate of the second fluid flow channel.

8. The push/pull-type closure of claim 1, wherein the misting nozzle is supported within a lumen of the stem of the chimney, and wherein the second fluid flow channel extends through the stem of the chimney.

9. The push/pull-type closure of claim 8, wherein the misting nozzle further comprises a misting cap body fixedly supported within a central lumen of the stem.

10. The push/pull-type closure of claim 9, wherein the misting nozzle further comprises a misting cap, the misting cap being located within the misting cap body, the misting cap positioned distally from the container within the misting cap body defining a misting cap lumen through which fluid flows.

11. The push/pull-type closure of claim 10, wherein the misting nozzle further comprises at least a spoke within the misting cap lumen, the spoke located distally from the misting cap within the misting cap lumen.

12. The push/pull-type closure of claim 11, wherein the misting nozzle further comprises a nozzle insert located within the misting cap lumen of the misting cap, the nozzle insert positioned to allow for the flow of fluid past the nozzle insert and the misting cap to the distal opening of the outer shell, the nozzle insert supported by at least one spoke.

13. The push/pull-type closure of claim 12, wherein the second fluid flow channel extends between the nozzle insert and the misting cap to the distal opening of the outer shell.

14. The push/pull-type closure of claim 8, wherein when the outer shell is in the first position, only the second fluid flow channel is open, wherein the second fluid flow channel defines a fluid flow rate therethrough.

15. The push/pull-type closure of claim 14, wherein when the outer shell is in the second position, the first fluid flow channel and the second fluid flow channel are open, wherein the first fluid flow channel has a fluid flow rate greater than the fluid flow rate of the second fluid flow channel.

16. A cap assembly for a fluid container, the cap assembly comprising:

a shell adapted to be secured to the fluid container, the shell including:

a cylindrical chimney defining a chimney lumen; and a stem supported within the chimney lumen by a plurality of spokes, the stem being configured and dimensioned such that a first fluid flow channel is defined between the chimney and stem providing fluid communication between an interior and an exterior of the container;

a cap coupled to the chimney of the shell, the cap defining a lumen therethrough and along the first fluid flow channel, the cap being axially movable relative to the chimney of the shell between a first position and a second position, wherein the first position a distal opening of the cap is of fluid sealing contact with the chimney of the shell to close the first fluid flow channel and wherein the second position the cap is extended away from the stem of the shell to open the first fluid flow channel; and a misting nozzle attached to the stem of the shell, the misting nozzle defining a second fluid flow channel therethrough, wherein the second fluid flow channel provides fluid communication between the interior and exterior of the container, wherein the second fluid flow channel is open at all times.

* * * * *